US009254558B1

(12) United States Patent
Knutson et al.

(10) Patent No.: US 9,254,558 B1
(45) Date of Patent: Feb. 9, 2016

(54) REVERSE SCISSOR TOOL FOR CLEANING AND FILLING RESEALABLE PLASTIC BAGS

(76) Inventors: Pat James Knutson, Desert Hot Springs, CA (US); Barbara Irene Noble, Desert Hot Springs, CA (US)

( * ) Notice: Subject to any disclaimer, the term of this patent is extended or adjusted under 35 U.S.C. 154(b) by 511 days.

(21) Appl. No.: 13/605,872

(22) Filed: Sep. 6, 2012

Related U.S. Application Data

(60) Provisional application No. 61/573,591, filed on Sep. 9, 2011.

(51) Int. Cl.
*B25B 27/20* (2006.01)
*B25B 7/12* (2006.01)

(52) U.S. Cl.
CPC ..... *B25B 27/205* (2013.01); *B25B 7/12* (2013.01)

(58) Field of Classification Search
CPC ..... B25B 7/12; B25B 27/205; B25B 7/00; B25B 7/14; B25B 7/02; B25B 7/18; B25B 7/04; B25B 7/10
USPC ..... 81/302, 303, 342, 343, 351, 485, 186; 156/94, 323, 304.7
See application file for complete search history.

(56) References Cited

U.S. PATENT DOCUMENTS

| | | | | |
|---|---|---|---|---|
| 5,382,151 | A * | 1/1995 | Hayes et al. | 425/392 |
| 6,364,979 | B1 * | 4/2002 | Grato | 156/94 |
| 2003/0041702 | A1 * | 3/2003 | Kang | 81/302 |
| 2005/0139043 | A1 * | 6/2005 | Kang | 81/302 |

* cited by examiner

*Primary Examiner* — Robert Scruggs
(74) *Attorney, Agent, or Firm* — Plager Schack LLP

(57) ABSTRACT

A reverse scissor tool can be used for cleaning and filling resealable plastic bags. The reverse scissor tool comprises a first handle mechanically coupled to a first body. The first handle is mechanically coupled to a second handle by a hinge. The second handle is further mechanically coupled to a second body. The first body is mechanically coupled to a first wing. The second body is mechanically coupled to a second wing. The reverse scissor tool can be inserted into a bag that has been turned inside out, and then gently expand the bag to expose all inside edges, corners, and seams for a thorough and complete cleaning.

3 Claims, 2 Drawing Sheets

REVERSE SCISSOR TOOL FOR CLEANING AND FILLING RESEALABLE PLASTIC BAGS

CROSS REFERENCE TO RELATED APPLICATIONS

This application claims priority to U.S. Provisional Application 61/573,591 filed on Sep. 9, 2011.

FIELD OF THE INVENTION

This invention relates to tools that be used in residential, commercial or industrial settings.

BACKGROUND OF THE INVENTION

Prior to the disclosed invention, tools could be used to clean or fill resalable plastic bags but could not accomplish both functions. The prior art includes: U.S. Pat. No. 5,353,805 issued to Mojena and U.S. Pat. No. 5,080,237 issued to Hefner.

Mojena provides on line of teaching, a bag opening and filling device that offers no theory on how to reverse and clean the bag. Conversely, Hefner teaches a holder for washing and drying bags that offers no teaching on how to fill the bag.

The current invention utilizes an entirely novel approach to accomplish these functions.

BRIEF SUMMARY OF THE INVENTION

A reverse scissor tool can be used for cleaning and filling resealable plastic bags. The reverse scissor tool comprises a first handle mechanically coupled to a first body. The first handle is mechanically coupled to a second handle by a hinge. The second handle is further mechanically coupled to a second body. The first body is mechanically coupled to a first wing. The second body is mechanically coupled to a second wing. The reverse scissor tool can be inserted into a bag that has been turned inside out, and then gently expand the bag to expose all inside edges, corners, and seams for a thorough and complete cleaning.

BRIEF DESCRIPTION OF THE SEVERAL VIEWS OF THE DRAWINGS

Figure 1:
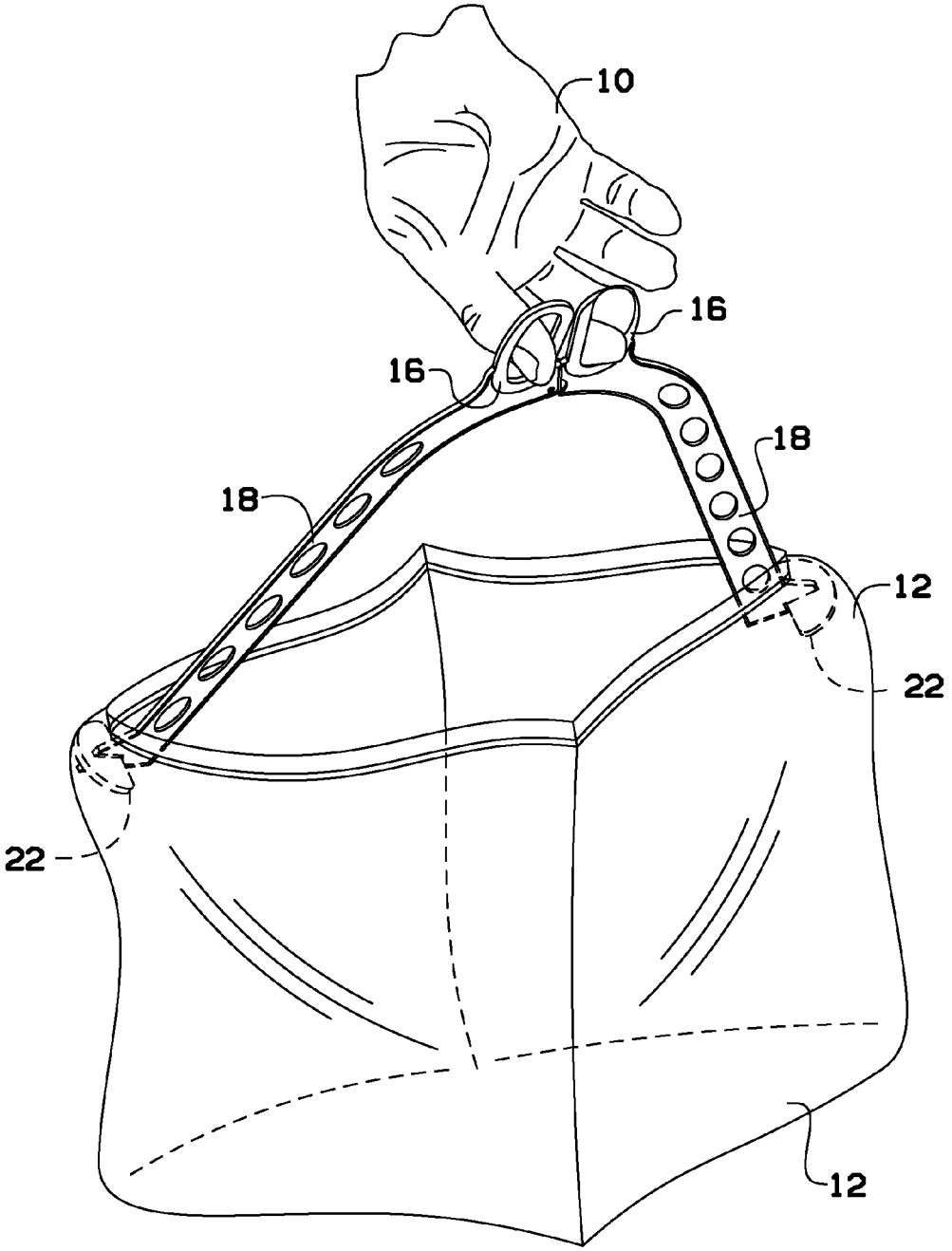

Having thus described the invention in general terms, reference will now be made to the accompanying drawings, which are not necessarily drawn to scale, and wherein:

FIG. 1: is a perspective view of the invention shown in use.

Figure 2:
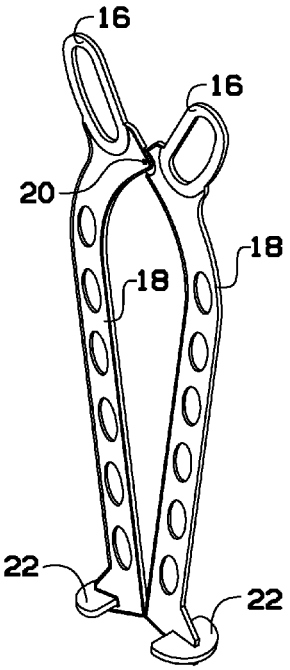

FIG. 2: is a perspective view of the invention shown in "closed" configuration.

Figure 3:
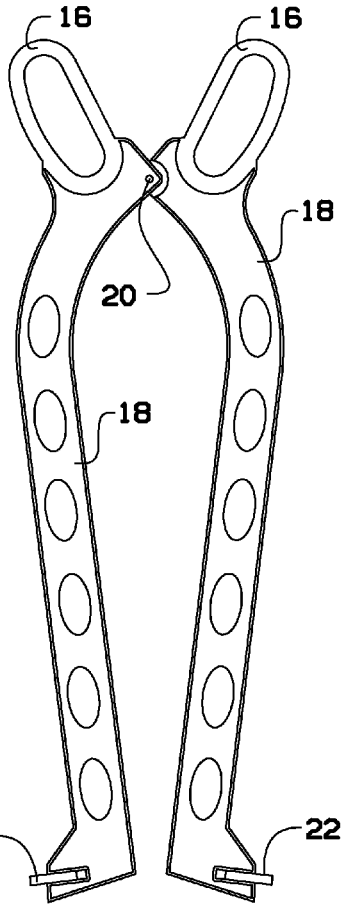

FIG. 3: is a front view of the invention.

Figure 4:
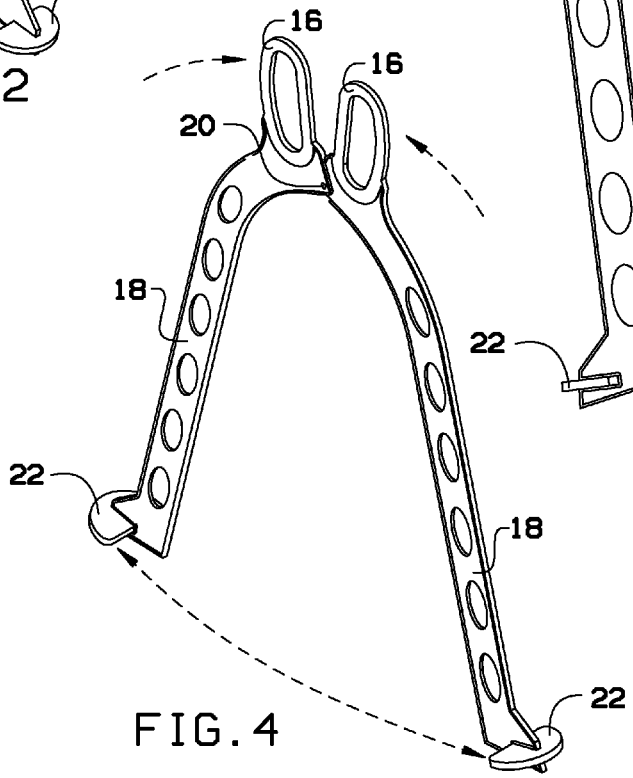

FIG. 4: is a perspective view of the invention shown in "open" configuration.

DETAILED DESCRIPTION OF THE INVENTION

Embodiments of the present invention overcome many of the obstacles associated with cleaning and filling resealable plastic bags, and now will be described more fully hereinafter with reference to the accompanying drawings that show some, but not all embodiments of the claimed inventions. Indeed, the invention may be embodied in many different forms and should not be construed as limited to the embodiments set forth herein. Rather, these embodiments are provided so that this disclosure will satisfy applicable legal requirements. Like numbers refer to like elements throughout.

FIG. 1 shows the invention in use. User 10 desires to clean and sanitize zipper-lock food storage bag 12 more efficiently and effectively, than by hand washing, and help prevent spillage when filling with a single tool. User 10 further desires to assist in recycling bag 12 by bag 12 over and over. A reverse scissor tool accomplishes these goals, which is shown in more detail in FIG. 2, FIG. 3 and FIG. 4. The reverse scissor tool can be inserted into bag 12 that has been turned inside out, and then gently expand that bag 12 to expose all inside edges, corners, and seams for a thorough and complete cleaning.

When handles 16 of the reverse scissor tool are squeezed together, bodies 18 spread apart and open bag 12. A unique feature of this design is that the first body 18 is curved inward at a first point and the second body 18 is curved inward at a second point, so that when the reverse scissor tool is used on the most popular size bags, it prevents the zipper seal from being broken. The top end of each side of body 18 is designed with a short-radius bend, so as to open and expose each corner of the bag.

The reverse scissor tool has at least two distinct functions. First, the reverse scissor tool can clean the inside of plastic zipper-lock bags, and an additional feature for holding the mouth of bag 12 open while filling with wings 22. This added feature is designed specifically to hold open bag 12 and retain this open position while pouring liquids into bag 12, thereby reducing possible spillage or burning oneself. This process of opening bag 12 is achieved by adding two wings 22 to the bodies 18 of the unit. These bodies 18 and wings 22, when fitted together, will fully hold open the mouth of bag 12, while liquids are being poured into bag 12.

FIG. 2, FIG. 3, and FIG. 4 show the reverse scissor tool. The reverse scissor tool comprises first handle 16 mechanically coupled to first body 18. First handle 16 is mechanically coupled to second handle 16 by hinge 20. Second handle 16 is further mechanically coupled to second body 18. First body 18 is mechanically coupled to first wing 22. Likewise, second body 18 is mechanically coupled to second wing 22.

While, the reverse scissor tool can be made of known materials, such as wood, plastic or metal using known woodworking, plastic working or metal working techniques, the following construction is preferred.

First, user 10 must obtain a sheet of plastic, large enough to make two separate and identical pieces for bodies 18 and handles 16 and a second smaller piece of plastic measuring approximately 2.5 inches square for the wings 22. Each of the two larger pieces must be cut so that when the handles 16 are squeezed together, each body 18 must move in an opposite direction of how a typical pair of scissors would move. This would make for the reverse scissor-action when operating the unit. Each of these two larger pieces would be roughly cut at 16 inches long by 3 inches wide by one-quarter inch thick with the inside edge of each body 18 measured to the outside edge of that same body 18, will be one inch wide. Each larger piece will have an offset scissor-type handle 16 on one end, with a hole drilled near the handle for the installation of a rivet as hinge 20 to couple the two larger pieces together. With hinge 20 installed, each body 18, starting at a hinge point, would flare out to a total unit width of 5 inches, then taper back inward so that the end of the bodies 18 would meet when the handles 16 are fully spread apart. At the end of both bodies 18, opposite the handles 16, the outside edges will be cut in a way so that when the handles 16 are squeezed together and the bodies 18 are spread to their widest point, the very end edges are cut in a perfectly straight line to one another. The outside edges at the end of both bodies 18, are cut in a way so that the outside edges of both, are exactly parallel to one another when the bodies 18 are closed together. The wings 22 will be cut from the smaller two and one-half inch piece of plastic. This would be accomplished by cutting out a two inch circle. That circle is then cut into two half-moons. In the center on the flat side of each semi-circle a notch is cut measuring one-quarter inch wide by three-eighths inch deep.

That which is claimed:

1. A reverse scissor tool for cleaning and filling resealable plastic bags, the reverse scissor tool comprises, a first handle mechanically coupled to a first body; wherein the first body has a first flared portion at a first distal end that flares away from the first handle; a first wing, attached within a slot of the first flared portion and with a first half-moon shape having a first flat edge and a first curved edge extending from opposing ends of said first flat edge such that said first flat edge is closest to the first body;

a second handle connected to the first handle with a hinge;

a second body, connected to the second handle; wherein the second body has a second flared portion at a second distal end that flares away from the second handle; a second wing, attached within a slot of the second flared portion and with a second half-moon shape having a second flat edge and a second curved edge extending from opposing ends of said second flat edge such that said second flat edge is closest to the second body.

2. The reverse scissor tool of claim 1, the first body is curved inward at a first point and the second body is curved inward at a second point, so that when the reverse scissor tool is used on the bag with a zipper seal, the reverse scissor tool expedites cleaning of the bag without breaking the zipper seal.

3. The reverse scissor tool of claim 1, a top end of the first body and the second body is designed with a short-radius bend, so as to open and expose each corner of the bag.

* * * * *